United States Patent [19]

Martel et al.

[11] 4,115,980

[45] Sep. 26, 1978

[54] WALL SYSTEM

[76] Inventors: Charles Siméon Martel, 36, blvd. Jacques Cartier, Lauzon, Quebec, Canada; Jean-Guy Papillon, 332, blvd. Centenaire; Paul Papillon, 186, blvd. Centenaire, both of St-Basile de Portneuf, Quebec, Canada, G0A 3G0

[21] Appl. No.: 721,102

[22] Filed: Sep. 7, 1976

[30] Foreign Application Priority Data

Sep. 10, 1975 [CA] Canada ..... 235380

[51] Int. Cl.[2] ..... E04C 1/10

[52] U.S. Cl. ..... 52/591; 46/26

[58] Field of Search ..... 52/591, 586, 593; 46/26

[56] References Cited

U.S. PATENT DOCUMENTS

| | | | |
|---|---|---|---|
| 1,115,542 | 11/1914 | Hudson | 52/591 X |
| 1,295,919 | 3/1919 | Muhlhausen | 52/591 X |
| 1,467,340 | 9/1923 | Siegel | 52/591 X |
| 3,686,817 | 8/1972 | Adams | 52/586 |
| 3,791,090 | 2/1974 | Kniefel | 52/593 |

FOREIGN PATENT DOCUMENTS

| | | | |
|---|---|---|---|
| 455,960 | 4/1949 | Canada | 52/591 |
| 989,096 | 5/1951 | France | 52/591 |
| 294,603 | 2/1954 | Switzerland | 52/591 |

*Primary Examiner*—J. Karl Bell

*Attorney, Agent, or Firm*—Raymond A. Robic; Francis B. Francois; Arthur Schwartz

[57] ABSTRACT

A substantially rectangular building block having means, for use in interlocking the block to other blocks, in at least one and normally both end walls and in the center of the block. The interlocking means comprise tapered dovetail slots in the end walls, extending over the height of the end walls, and a double dovetail-shaped, tapered through opening in the center of the block. The invention also covers a wall built from these blocks using locking pins which cooperate with the interlocking means.

5 Claims, 7 Drawing Figures

WALL SYSTEM

This invention relates to improvements in blocks for use in constructing walls, or similar structures, and to walls or structures constructed from the improved blocks.

The invention is more particularly directed toward improvements in blocks for use in constructing walls or similar structures, which blocks are interlocked together, and to walls or structures constructed from the improved, interlockable blocks.

It is known to use interlockable blocks for wall construction. See U.S. Pat. No. 2,392,551; issued Jan. 8, 1946; J. Roe inventor; for an example of such known blocks. Interlockable blocks permit walls to be constructed without the use of cement or other binding material. Thus walls, or other structures, can be speedily, simply constructed. The blocks are usually provided with self-aligning means so that a straight, relatively stable structure can be quickly built.

The known blocks however do not provide walls which are very strong. More particularly, the courses of blocks in the walls are not strongly interlocked to one another. Also, it is difficult to take down a wall structure built from the known blocks without damaging the blocks. If the blocks are damaged, they cannot be reused.

It is therefore one purpose of the present invention to provide an improved, lockable block which is designed to permit construction of stronger walls or structures. It is another purpose of the present invention to provide improved, lockable blocks which can be reused many times to build temporary, knock-down walls or structures.

In accordance with the present invention, the blocks are provided with means for use in interlocking adjacent blocks in one course, and adjacent blocks in adjacent courses. The adjacent courses are interlocked substantially over the height of both courses to provide a stronger wall. Locking pins, cooperating with the interlocking means, have a length substantially equal to the height of two blocks.

The locking pins also are provided with means which facilitate their removal from the blocks so that a wall can be easily dismantled with minimum or no damage to the blocks.

The subject invention particularly proposes a substantially rectangular building block having means for use in interlocking the block to other blocks. The interlocking means are located in at least one end wall of the block and in the center of the block. The interlocking means at both locations extend over the height of the block.

The invention is also particularly directed toward a wall structure comprising courses of substantially rectangular building blocks. The blocks in each course are offset longitudinally a distance equal to one-half the length of a block with respect to blocks in adjacent courses. Each block has means for use in interlocking the block to other blocks in the same course and to blocks in the adjacent lower course. The interlocking means are located in at least one end wall of the block and in the center of the block. The interlocking means at both locations extend the height of the blocks. Locking pins are provided, cooperating with the interlocking means. Each locking pin has a length substantially equal to the height of two blocks.

The invention will now be described in detail having reference to the accompanying drawings in which.

Figure 1:
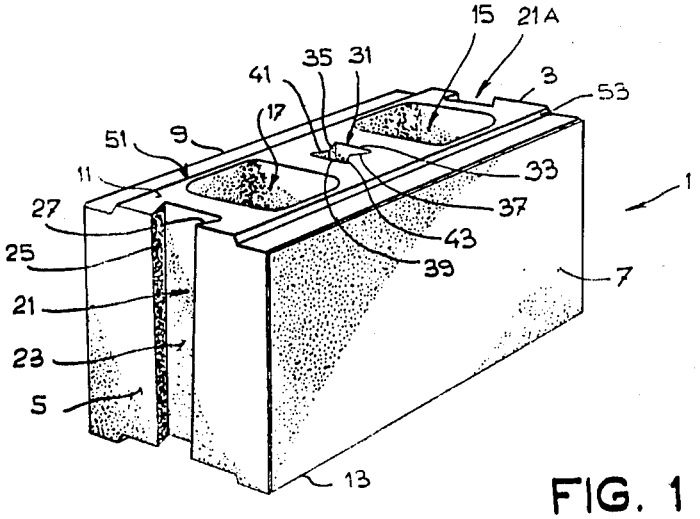
FIG. 1 is a perspective view of a block according to the present invention.
Figure 2:
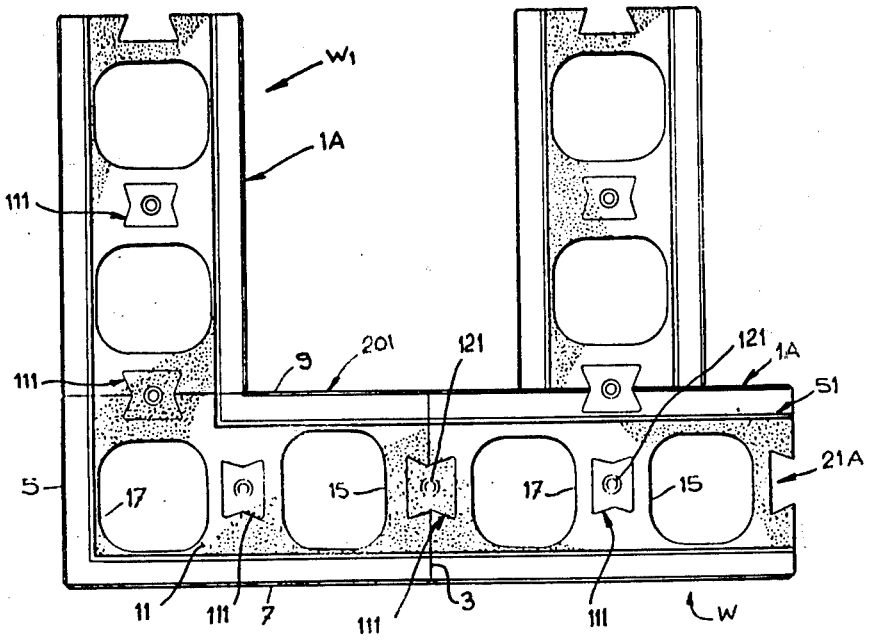
FIG. 2 is a plan view of a wall employing the blocks.
Figure 4:
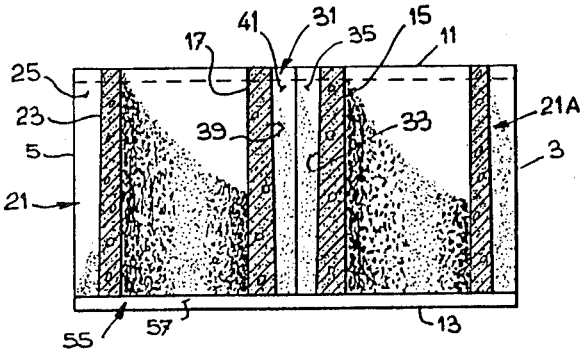
FIG. 4 is a longitudinal cross-section view of a block.

In accordance with the present invention, a block 1 is provided for wall construction, which, as shown in FIGS. 1 and 4, has a substantially rectangular shape. The block 1 has end walls 3, 5, side walls 7, 9, a top wall 11 and a bottom wall 13. The block 1 is usually molded from a concrete or cement mixture, and preferably has a pair of through vertical holes 15, 17, one at each end of the block to lighten it. The holes 15, 17 preferably have a generally rectangular shape.

Each block 1 is provided with a vertical slot 21 in at least one end wall 5 of the block. The slot 21 extends over the height of the end wall 5, and is located in the center of the end wall. The slot 21 preferably has a dovetail shape with a back wall 23 and sidewalls 25, 27 which angle from back wall 23 toward each other. The slot 21 also tapers down from the top wall 11 to the bottom wall 13. More specifically, back wall 23 angles toward end wall 5 going from top to bottom of the block and sidewalls 25, 27 angle toward each going from top to bottom. The slot 21 is used to interlock one block to an adjacent block in a row or course of blocks as will be described.

A second slot 21A, identical to first slot 21, is normally provided in the other end wall 3 of block 1 as well for use in interlocking the block to other adjacent blocks.

Each block 1 is also provided with a centrally located, through vertical hole 31. The hole 31 preferably is shaped to define two identical dovetail shapes positioned face to face. One dovetail shape has a back wall 33 and sidewalls 35, 37 which angle from back wall 33 toward each other. The other dovetail shape, identical to the first, has a back wall 39 and sidewalls 41, 43 which angle from backwall 39 toward each other. Backwalls 33, 39 form the endwalls of opening 31; sidewalls 35, 41 one sidewall of the opening; and sidewalls 37, 43 the other sidewall of the opening.

The opening 31 tapers down from the top wall 11 to the bottom wall 13 and is used in interlocking the block to blocks in an adjacent course. In accordance with the present invention, each of the two dovetail shapes defining the opening 31 have the same shape as either dovetail slot 21 or 21A, but a different size. The cross-sectional area of either dovetail shape defining opening 31, at top wall 11, is the same as the cross-sectional area of either slot 21 or 21A, at the bottom wall 13. The opening 31 preferably tapers down at the same angle as do slots 21, 21A.

Each block 1 is also preferably provided with a longitudinal extending, raised step 51 on its top wall 11. The step 51 is centrally located on top wall 11 and preferably is slightly wider than one-half the width of block 1. The sides 53 of the step 51 can be bevelled if desired. A complementary, longitudinally extending recess 55 is provided in the bottom wall 13 of block 1. The recess 55 is centrally located on bottom wall 13 and sized to receive a step 51 on an adjacent block when building a wall as will be described. The sides 57 of recess 55 also are bevelled.

Figure 3:
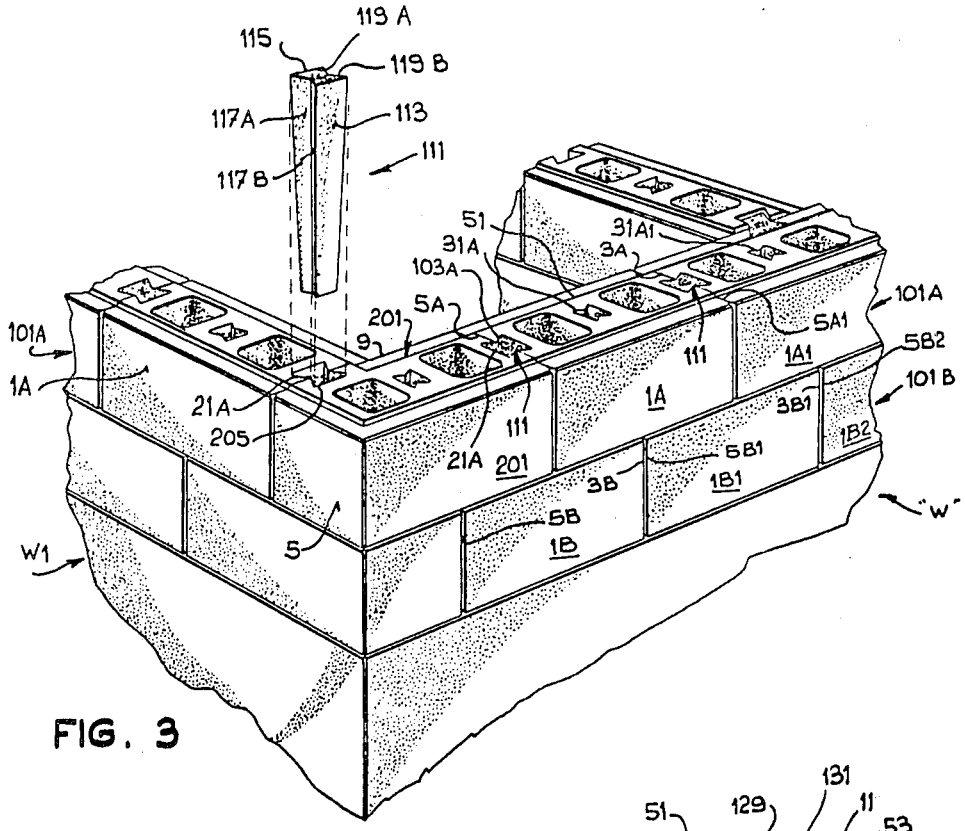
FIG. 3 is a perspective view of a wall employing the blocks.
Figure 6:
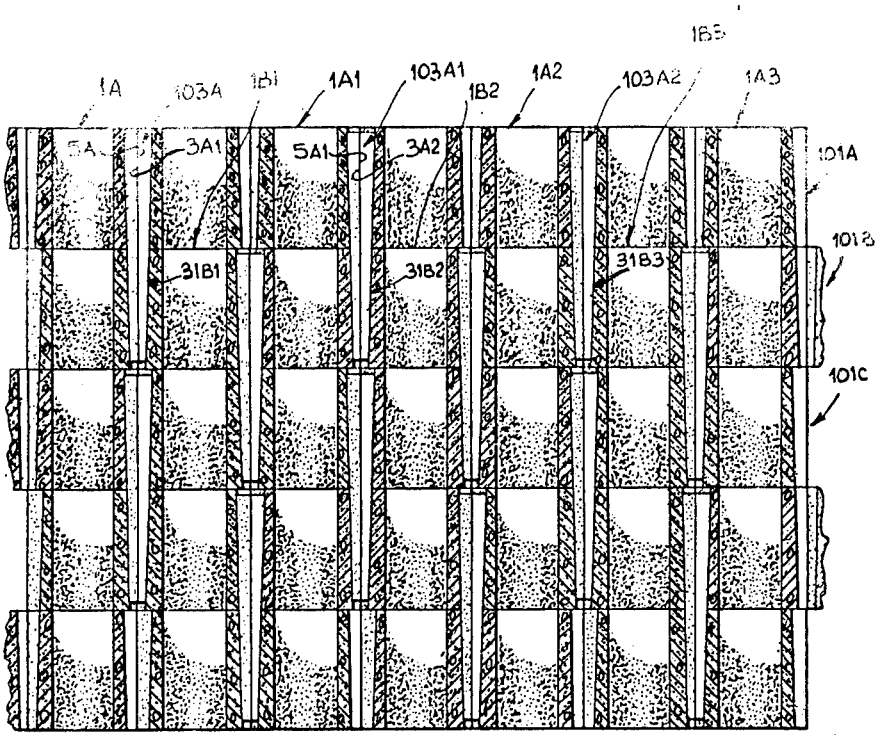
FIG. 6 is a longitudinal cross-section view of wall employing the blocks.

Blocks 1, as described above, are used in building walls, without requiring the use of cement to hold the blocks together. The blocks 1 are laid in rows or courses 101A, 101B, 101C, etc. as shown in FIGS. 3 and 6. The blocks in each course are staggered with respect to the blocks in adjacent courses by half a block length. The blocks 1A, $1A_1$, $1A_2$ etc. in each course 101A, etc. are placed with their end walls 3, 5 abutting. When end walls 3, 5 of adjacent blocks abut, the slots 21, 21A in these end walls form openings 103 having generally the same shape as openings 31. The formed openings 103A, $103A_1$, $103A_2$, in each course 101A, etc. are respectively aligned with the openings 31B, $31B_1$, $31B_2$ etc. in blocks 1B, $1B_1$, $1B_2$ in the adjacent course 101B below. Opening 31, in effect, forms a continuation of formed opening 103.

Locking pins 111 are provided for insertion into openings 103 and aligned openings 31. The pins 111 can be made from the same material as the blocks. Each locking pin 111 has a length substantially equal to the height of two blocks. The locking pin 111 has the same double dovetail shape as openings 103 and 31 and tapers at the same angle. The pin 111 has straight, tapering sidewalls 113, 115 and tapering endwalls 117, 119. Each endwall 117, 119 comprises two inwardly angled portions 117A, 117B and 119A, 119B. The top of pin 111 has a size and shape substantially equal to the size and shape of the top of formed opening 103. The bottom of pin 111 has a size and shape substantially equal to the size and shape of the bottom of opening 31.

Figure 5:
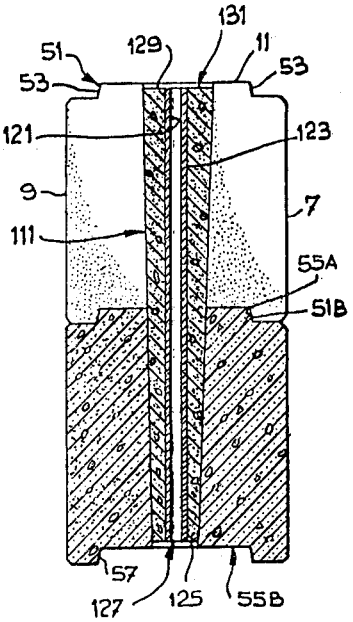
FIG. 5 is a transverse cross-section view of two rows of blocks showing one blocking pin.

The pin 111 is driven into a formed opening 103 in one course 101A, and down into an aligned opening 31 in an adjacent bottom course 101B. The pin 111 is firmly wedged into the openings and locks two adjacent blocks in one course together and these two blocks to a block in a course below. In addition, the recesses 55A in the blocks 1A in one course 101A, receive the steps 51B in the blocks 1B in an adjacent course 101B to aid in locking the blocks in adjacent course together to prevent relative lateral movement of the courses, as shown in FIG 5.

It will be seen that the blocks 1 and pins 111 are easily assembled into a wall "W", that is quite strong. The wall "W" is also easily dismantled. To dismantle the wall, each pin 111 is provided with a central through opening 121. The hole 121 may be provided by a tube 123 centrally located in pin 111. Each pin 111 preferably has a length slightly less than the height of two blocks. Thus, the bottom 125 of pin 111 does not reach the recess 55B in the bottom of two blocks, when wedged in the blocks as shown in FIG. 5. A space 127 is left between the bottom 125 of pin 111 and recess 55. In addition, the top 129 of pin 111 is located slightly below top wall 11 when wedged in the blocks. This leaves a space 131 between the top 129 of pin 111 and wall 11.

Figure 7:
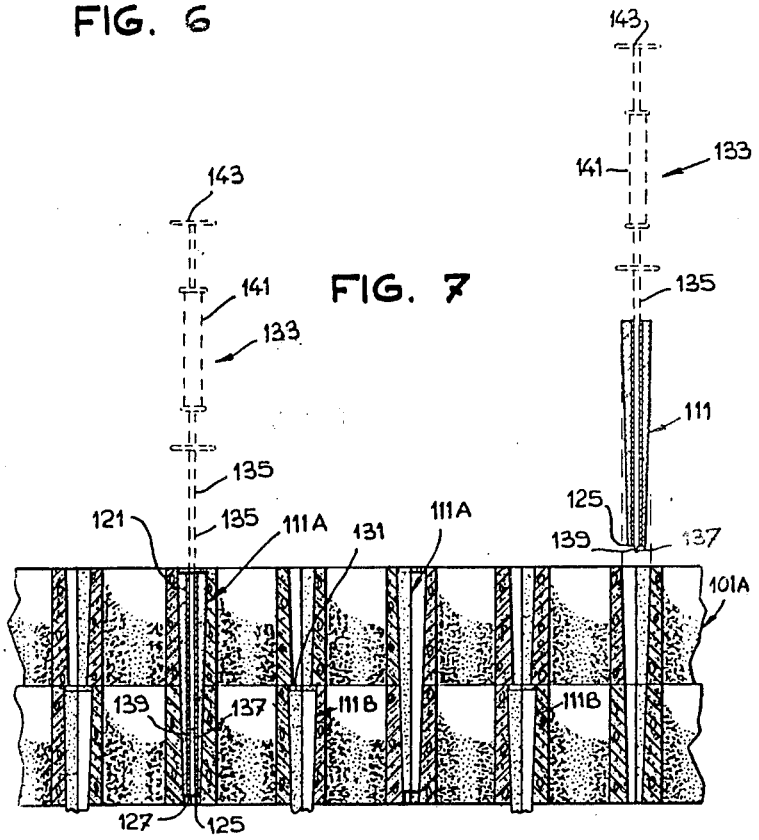
FIG. 7 illustrates dismantling of the wall.

A hydraulic extraction tool 133 is used in taking down the wall as shown in FIG. 7. The tool 133 has a rod 135 which is sized to pass through hole 121 in pin 111. The rod 135 has a laterally extending stub finger 137 at its free end 139. This finger 137 passes through hole 121 as well into space 127, and space 131, if present, beneath pin 111. The rod 135, and finger 137, is then maneouvered to hook the finger 137 onto the bottom 125 of pin 111 as shown in FIG. 7. A hydraulic cylinder 141, operatively connected to rod 135 is then manually actuated by handle 143 to raise the wedged pin 111 out of openings 103, 31. When the pins 111A in the top row 101A have been removed, the top row 101A of blocks 1A can be removed from wall "W" providing access to remove the next row of pins 111B. The pins 111 and blocks 1 can be reused many times.

Special blocks 201 can be provided for making corners in walls. Block 201 is specifically provided for corner construction and has a slot 21A in one endwall 3, as before, but instead of a another slot 21 in the other endwall 5, it has a second vertical slot 205 in one sidewall 9, near the other endwall 5. The slot 205 is spaced one-half of the width of a block 1 from the endwall 5 and is identical to slot 21A. In building a corner, block 201 has slot 21A in endwall 3 cooperate with a slot 21 in adjacent block 1A in row 101A in wall "W" to form opening 103A. Slot 205 in sidewall 9 of block 201 cooperates with slot 21A in block 1A in row 101A of wall "$W_1$" to form another opening 103A. Block 201 can be made for left or right hand use. It will be noted that lightening hole 17 in corner block 201, adjacent endwall 5, is slightly smaller than normal to accomodate slot 205 in sidewall 9.

The embodiments of the invention in which an exclusive property or privilege is claimed are defined as follows:

1. A wall structure comprising a plurality of courses of substantially rectangular building blocks of substantially uniform height, the blocks in each course being offset longitudinally a distance equal to one-half the length of a block with respect to blocks in adjacent courses, each block having means for use in interlocking the block to other blocks in the same course and to blocks in the adjacent lower course, the interlocking means being located in at least one endwall of the block and in the center of the block, and at both locations extending the full height of the block, the interlocking means in the endwall of each block comprising a vertical dovetail slot positioned centrally of the endwall and tapering uniformly down from the top to the bottom of the block, each slot being adapted to confront another, substantially identical slot in another block of the same course, and the interlocking means in the center of each block comprising a centrally positioned through vertical opening having the shape of two of said dovetail slots positioned in face to face relationship, said opening tapering down at the same angle from the top to the bottom of the blocks as said dovetail slot, the dovetail slot at the bottom of each block having a size equal to about one-half of the size of said slot at the top of the block, and said vertical opening having a size at the top of the block equal to about the size of two of said dovetail slots positioned in face to face relationship at the bottom of said block, said blocks, said slots and said openings being dimensioned so that when placed in adjacent courses the axis of each confronting pair of said slots in aligned with the axis of one of said vertical openings, and removable locking pins made from the same material as the blocks and having straight sidewalls tapering at the same angle as the interlocking means and cooperating therewith, each locking pin having the complementary shape of two dovetail slots positioned in face to face relationship and a length substantially equal to the height of two of said blocks, each locking pin having a size at its large end about equal to the size of two of said dovetail slots in face to face relationship at the top of said block, and a size at its small end substantially equal to the size of the opening at the bottom of the block, said tapering locking pins being adapted to be inserted into said aligned tapered slots and openings and driven home to form a wedge fit, with the straight sidewalls of said pins in frictional engagement with the walls defining said aligned slots and openings.

2. A wall structure as claimed in claim 1 wherein each locking pin has a central through bore for use in removing the pins from the blocks.

3. A wall structure as claimed in claim 1, including interlocking means in the other endwall of at least a majority of the blocks, the interlocking means in the other endwall being a dovetail slot identical in configuration and location to the dovetail slot in the one endwall.

4. A wall structure as claimed in claim 1, including interlocking means in one sidewall of some of the blocks in the wall structure, the interlocking means in the sidewall being spaced a distance equal to one-half the width of the block from the other endwall of the block, the interlocking means in the sidewall being a dovetail slot identical to the dovetail slot in the one endwall, and cooperating with the interlocking means in the one endwall of an adjacent block in the same course, at a corner of the wall, to form an opening, the thus formed corner opening overlying and being centered with the central opening in a block in the adjacent bottom course.

5. A wall structure as claimed in claim 1 including a longitudinally extending, raised portion on the top wall of each block, and a complementary, longitudinal extending recess in the bottom wall of each block.

* * * * *